US007256544B2

(12) United States Patent
Son et al.

(10) Patent No.: US 7,256,544 B2
(45) Date of Patent: Aug. 14, 2007

(54) PLASMA FLAT LAMP

(75) Inventors: Seung-hyun Son, Gyeonggi-do (KR); Hyoung-bin Park, Gyeonggi-do (KR); Gi-young Kim, Gyeonggi-do (KR); Kyung-min Chung, Gyeonggi-do (KR); Young-mo Kim, Gyeonggi-do (KR); Sang-hun Jang, Gyeonggi-do (KR); Seong-eui Lee, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 337 days.

(21) Appl. No.: 10/989,003

(22) Filed: Nov. 16, 2004

(65) Prior Publication Data

US 2005/0116639 A1 Jun. 2, 2005

(30) Foreign Application Priority Data

Nov. 27, 2003 (KR) ..... 10-2003-0084958

(51) Int. Cl.
*H01J 17/49* (2006.01)

(52) U.S. Cl. ..... 313/582; 313/586

(58) Field of Classification Search ..... 313/422, 313/489, 582, 586, 587
See application file for complete search history.

(56) References Cited

U.S. PATENT DOCUMENTS 4,198,585 A * 4/1980 Yamashita et al. ..... 313/587
4,843,281 A * 6/1989 Mendelsohn ..... 313/587
2003/0098643 A1 5/2003 Park et al.

FOREIGN PATENT DOCUMENTS

| | | |
|---|---|---|
| EP | 550047 A2 * | 7/1993 |
| JP | 61-185858 | 8/1986 |
| JP | 02-112145 | 4/1990 |
| JP | 05-121003 | 5/1993 |
| JP | 09-102280 | 4/1997 |
| JP | 2000-090884 | 3/2000 |
| JP | 2000-228172 | 8/2000 |
| JP | 2000-323093 | 11/2000 |
| JP | 2001-222944 | 8/2001 |
| JP | 2003-017005 | 1/2003 |
| JP | 2003-346729 | 12/2003 |

* cited by examiner

*Primary Examiner*—Vip Patel
(74) *Attorney, Agent, or Firm*—Buchanan Ingersoll & Rooney PC

(57) ABSTRACT

Provided is a plasma flat lamp. The provided lamp includes a discharge gas filled in a discharge area of a discharge container, at least two electrodes generating a gas discharge in the discharge area, a low work function material layer located in a discharge path between the electrodes and collided against gas ions that are generated by the gas discharge, and a fluorescent layer generating visible rays by ultraviolet rays that are generated by the gas discharge in the discharge container. The provided plasma flat lamp reduces a driving voltage due to the low work function material layer against which ions are collided, and increases luminescent efficiency by reducing the absorption of ultraviolet rays of the low work function material layer.

13 Claims, 6 Drawing Sheets

PLASMA FLAT LAMP

BACKGROUND OF THE INVENTION

This application claims the priority of Korean Patent Application No. 2003-84958, filed on Nov. 27, 2003, in the Korean Intellectual Property Office, the disclosure of which is incorporated herein in its entirety by reference.

FIELD OF THE INVENTION

The present invention relates to a plasma flat lamp, and more particularly, to a plasma flat lamp with high luminance and luminescent efficiency and a uniform luminance distribution.

DESCRIPTION OF THE RELATED ART

A flat lamp used as a back-light of a liquid crystal display (LCD) has been developed from an edge-light type or a direct-light type using a cold cathode fluorescent lamp to a surface discharge type or a facing surfaces discharge type using a lower portion of a luminescent surface as a discharge area to improve luminescent efficiency and luminance uniformity.

The US Published Patent Application No. US-2003-0098643-A1 discloses problems of various discharge types and a method of solving the problems. It is important to improve the luminescent efficiency of a plasma lamp and to develop a technology of driving a plasma lamp at a low power in order to improve the performance of a plasma lamp and to reduce the cost of a plasma lamp. In general, a surface discharge type plasma lamp has a merit of a stable discharge characteristic compared to a facing surfaces discharge type plasma lamp; however, the luminance of the surface discharge type plasma lamp is lower than that of the facing surfaces discharge type plasma lamp. In order to improve the luminescent efficiency, a discharge gap is increased. Here, the increase of a discharge gap is limited by the size of a discharge area. Another method of improving the luminescent efficiency is increasing the total gas pressure of a discharge gas, for example, Ne—Xe, or increasing the partial pressure of Xe. However, when the total gas pressure or the partial pressure of Xe is increased, a high discharge voltage is required. When the discharge voltage is increased, the lifespan of a lamp is reduced and a manufacturing cost of a driver, which drives the lamp, is increased.

SUMMARY OF THE INVENTION

The present invention provides a plasma flat lamp with high luminescent efficiency and a low operation voltage to increase a lifespan and to decrease a manufacturing cost.

According to an aspect of the present invention, there is provided a plasma flat lamp comprising a discharge container including a first plate and a second plate that maintain a predetermined distance to form a discharge area in which a discharge gas is filled, the discharge gas filled in the discharge area of the discharge container, at least two electrodes formed on the discharge container and generating a gas discharge in the discharge area, a fluorescent layer generating visible rays by ultraviolet rays that are generated by the gas discharge in the discharge container, and a low work function material layer located in a discharge path between the electrodes and collided against gas ions that are generated by the gas discharge.

According to another aspect of the present invention, there is provided a plasma flat lamp comprising a first plate and a second plate maintaining a predetermined distance to form a discharge area in which a discharge gas is filled, the discharge gas filled in the discharge area, at least two electrodes formed on a surface of the first plate facing the second plate, a dielectric layer formed on a surface of the first plate facing the second plate and covering the electrodes, a low work function material layer formed on the dielectric layer to correspond to the electrodes, and a fluorescent layer formed on portions of the dielectric layer where the low work function material layer is not formed to expose the low work function material layer to the discharge area.

In this case, the fluorescent layer may extend to areas between the dielectric layer and the low work function material layer, or the low work function material layer may be formed on an entire surface of the dielectric layer.

According to still another aspect of the present invention, there is provided a plasma flat lamp comprising a first plate and a second plate maintaining a predetermined distance to form a discharge area in which a discharge gas is filled, the discharge gas filled in the discharge area, at least two electrodes formed on a surface of the first plate facing the second plate, a dielectric layer formed on a surface of the first plate facing the second plate and covering the electrodes, a fluorescent layer formed on the dielectric layer, and a low work function material layer formed on the dielectric layer to a thickness of 80 to 200 Å.

Here, the electrodes are formed on an inner surface of an outer surface of the discharge container, more specifically, on an inner surface or an outer surface of at least one of the first plate and the second plate.

In addition, the low work function material layer is formed in a lower portion or an upper portion of the fluorescent layer. The fluorescent layer may be formed at a portion deviated from the discharge path.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
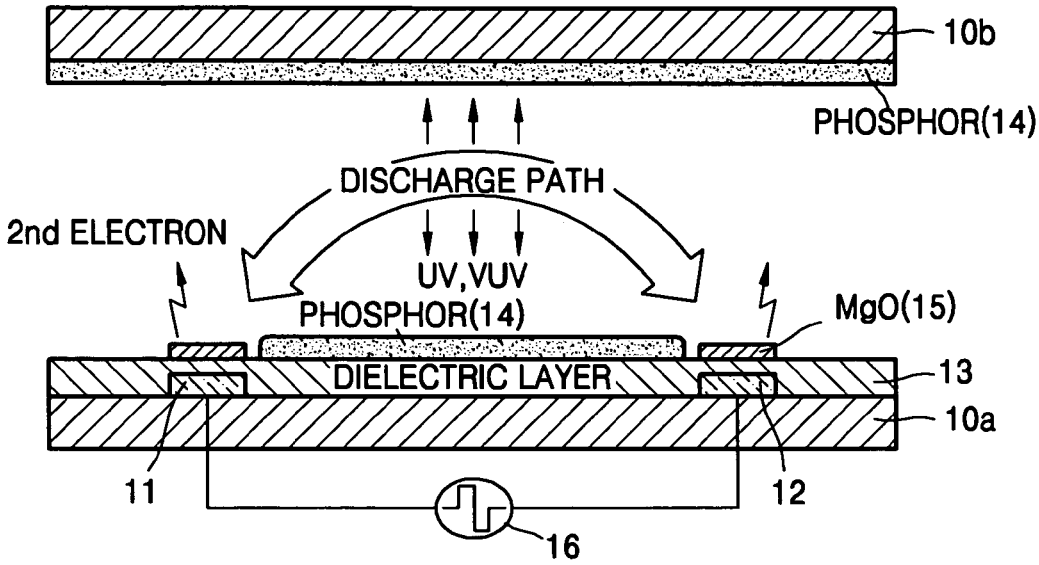
FIG. 1 is a sectional view illustrating a plasma flat lamp according to a first embodiment of the present invention.

Referring to FIG. 1, electrodes 11 and 12 connected to a driving power 16 are formed on a first plate 10*a*, and a dielectric layer 13 is formed on the electrodes 11 and 12. In addition, a fluorescent layer 14 and low work function material layers 15 are formed on the dielectric layer. Here, the low work function material layers 15, such as MgO, are arranged on a discharge path between the electrodes 11 and 12 to generate secondary electrons due to the collision of ions during a discharge. In addition, the fluorescent layer 14 is arranged to prevent the reduction of the incidence amount of ultraviolet rays to the fluorescent layer 14 by preventing the low work function material layers 15 from absorbing the ultraviolet rays. Thus, the low work function material layers 15 are formed on the discharge electrodes 11 and 12, and the fluorescent layer 14 is formed on the other portions. On the other hand, another fluorescent layer 14 is formed on a surface of a second plate 10*b* facing the first plate 10*a*.

According to the above-described structure, the ions collide against the low work function material layers 15 on the electrodes 1 and 12 when a gas discharge occurs between the electrodes 11 and 12, thus the secondary electrons are generated to reduce a discharge voltage. On the other hand, the ions do not collide against the fluorescent layer 14, thus the fluorescent layer 14 is protected from the ion collision.

Figure 2:
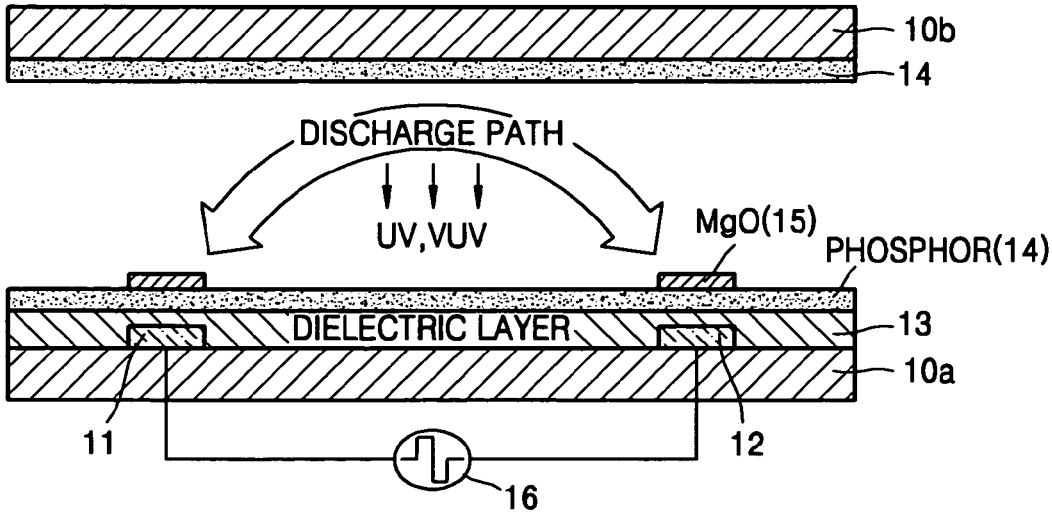
FIG. 2 is a sectional view illustrating a plasma flat lamp according to a second embodiment of the present invention.

Referring to FIG. 2, electrodes 11 and 12 connected to a driving power 16 are formed on a first plate 10*a*, and a dielectric layer 13 is formed on the electrodes 11 and 12. In addition, a fluorescent layer 14 is formed on an entire surface of the dielectric layer, and low work function material layers 15 are partially formed on the fluorescent layer 14. Here, the low work function material layers 15, such as MgO, are arranged on the portions above the electrodes 11 and 12 to generate secondary electrons due to the collision of ions during a discharge. In addition, the low work function material layers 15 are not formed on the portions deviated from the electrodes 11 and 12 to prevent the reduction of the incidence amount of ultraviolet rays to the fluorescent layer 14 by preventing the low work function material layers 15 from absorbing the ultraviolet rays. On the other hand, another fluorescent layer 14 is formed on a surface of a second plate 10*b* facing the first plate 10*a*.

According to the above-described structure, the ions collide against the low work function material layers 15 on the electrodes 11 and 12 when a gas discharge occurs between the electrodes 11 and 12, thus the secondary electrons are generated to reduce a discharge voltage. On the other hand, the ions do not collide against the fluorescent layer 14, thus the fluorescent layer 14 is protected from the ion collision.

Figure 3:
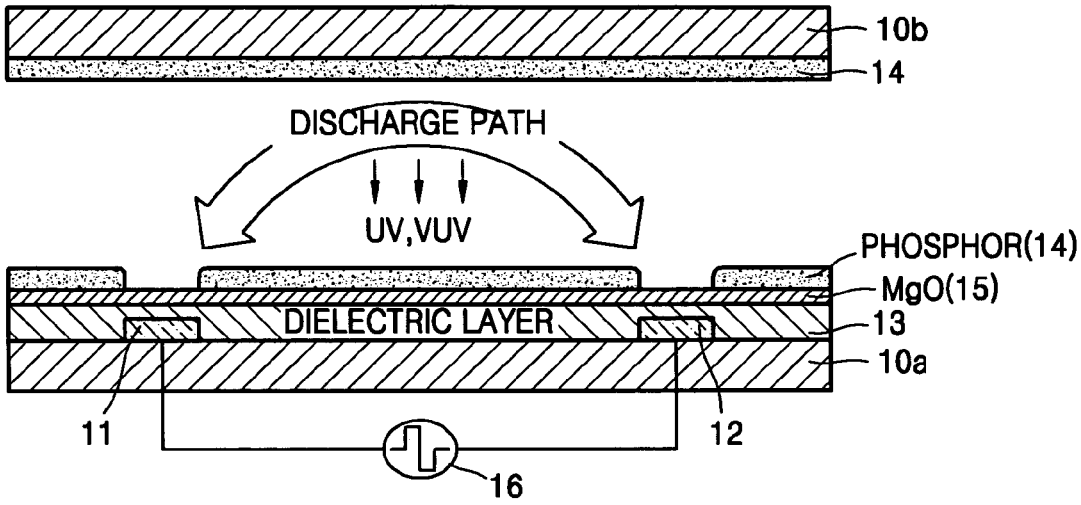
FIG. 3 is a sectional view illustrating a plasma flat lamp according to a third embodiment of the present invention.

Referring to FIG. 3, electrodes 11 and 12 connected to a driving power 16 are formed on a first plate 10*a*, and a dielectric layer 13 and a low work function material layer 15 are sequentially formed on the electrodes 11 and 12. In addition, a fluorescent layer 14 is formed on the low work function material layers 15 except the portions above the electrodes 11 and 12 in order to generate secondary electrons by colliding ions against the low work function material layer 15 when a discharge occurs on a discharge path between the electrodes 11 and 12. On the other hand, another fluorescent layer 14 is formed on a surface of a second plate 10*b* facing the first plate 10*a*.

According to the above-described structure, the ions collide against the low work function material layer 15 on the electrodes 11 and 12 when the gas discharge occurs between the electrodes 11 and 12, thus the secondary electrons are generated to reduce a discharge voltage. On the other hand, the ions do not collide against the fluorescent layer 14, thus the fluorescent layer 14 is protected from the ion collision.

Figure 4:
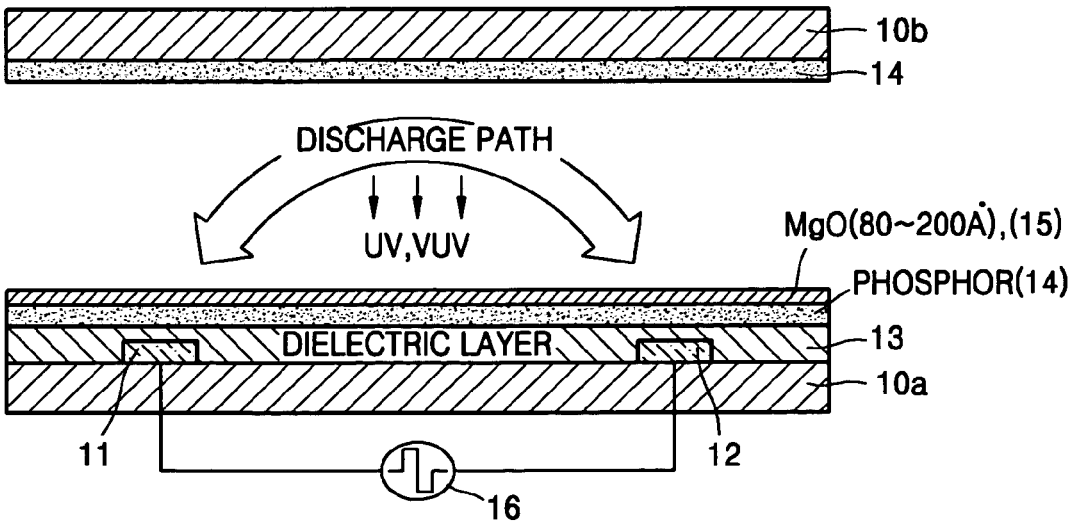
FIG. 4 is a sectional view illustrating a plasma flat lamp according to a fourth embodiment of the present invention.

Referring to FIG. 4, electrodes 11 and 12 connected to a driving power 16 are formed on a first plate 10*a*, and a dielectric layer 13 is formed on the electrodes 11 and 12. In addition, a fluorescent layer 14 is formed on the dielectric layer 13, and a low work function material layer 15 is formed on the fluorescent layer 14. Here, the low work function material layer 15 is formed on the entire surface of the fluorescent layer 14 as well as on the portions above the electrodes 11 and 11 against with ions collide when a discharge occurs between the electrodes 11 and 12. When the low work function material layer 15 is formed on the entire surface of the fluorescent layer 14, a driving voltage may be lowered due to the generation of secondary electrons; however, the incidence amount of ultraviolet rays to the fluorescent layer 14 may be reduced because the low work function material layer 15 absorbs the ultraviolet rays. In order to minimize the absorption of the ultraviolet rays by the low work function material layer 15, the low work function material layer 15 is formed to a thickness of from 80 to 200 Å.

On the other hand, the function of the dielectric layer 13 may be performed by the first plate 10*a* by forming the electrodes 11 and 12 on one surface of the first plate 10*a* and forming the fluorescent layer 14 and the low work function material layer 15 on the other surface of the first plate 10*a*.

Figure 5:
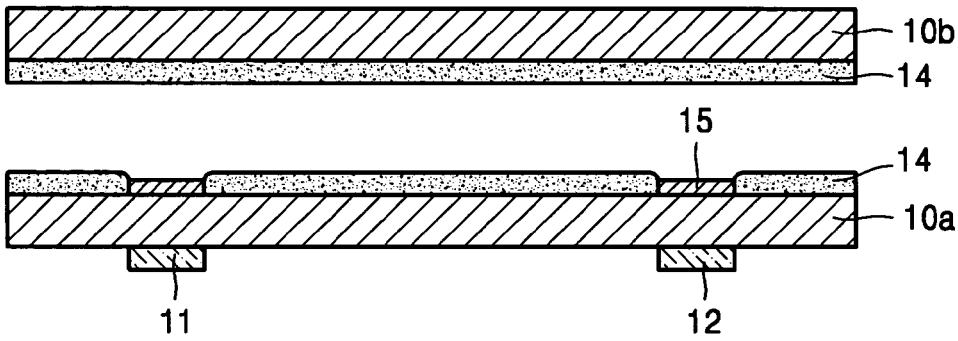
FIG. 5 is a sectional view illustrating a plasma flat lamp in which a substrate is used as a dielectric layer according to a fifth embodiment of the present invention.
Figure 6:
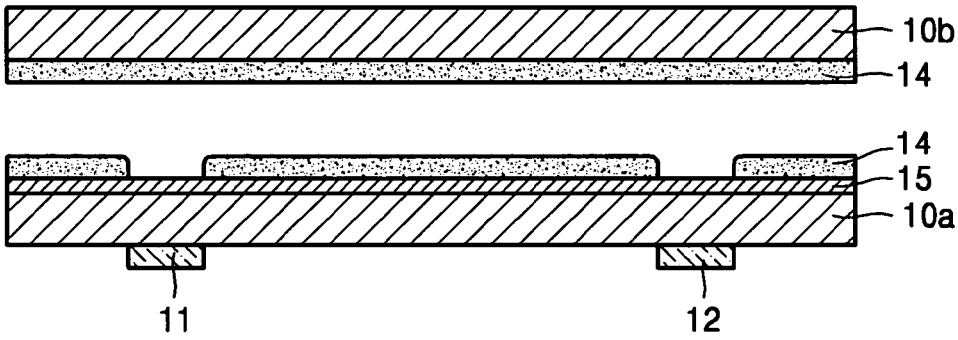
FIG. 6 is a sectional view illustrating a plasma flat lamp in which a substrate is used as a dielectric layer according to a sixth embodiment of the present invention.
Figure 7:
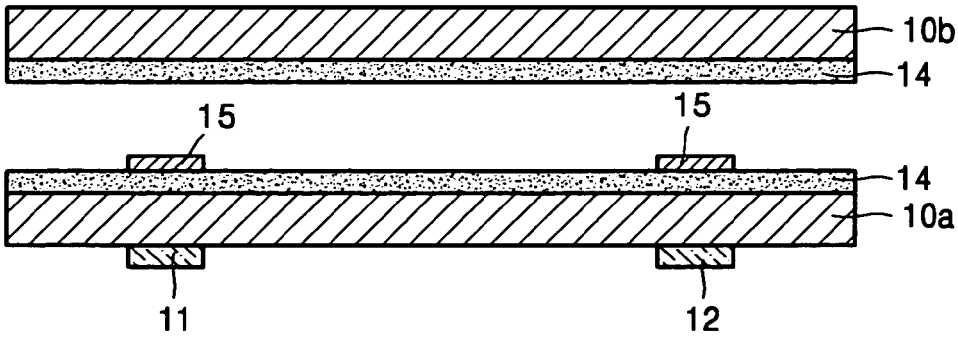
FIG. 7 is a sectional view illustrating a plasma flat lamp in which a substrate is used as a dielectric layer according to a seventh embodiment of the present invention.

FIGS. 5 through 7 are sectional views illustrating plasma flat lamps in which a first plate operate as a dielectric for AC driving as well as an element of the plasma flat lamp.

Referring to FIG. 5, fluorescent layers 14 and low work function layers 15 are formed on a surface of a first plate 10*a* facing a second plate 10*b*, and discharge electrodes 11 and 12 are formed on the other surface of the first plate 10*a*. The low work function material layers 15 are formed to correspond to the electrodes 11 and 12, and the fluorescent layers 14 are formed on the other portions.

Referring to FIG. 6, a low work function layer 15 is formed on an entire surface of a first plate 10*a* facing a second plate 10*b*, and discharge electrodes 11 and 12 are formed on the other surface of the first plate 10*a*. In addition, fluorescent layers 14 are formed on the low work function material layer 15 on the portions except for the portions corresponding to the electrodes 11 and 12. Thus, portions of the low work function material layer 15 corresponding to the electrodes 11 and 12 are exposed.

Referring to FIG. 7, a fluorescent layer 14 is formed on an entire surface of a first plate 10*a* facing a second plate 10*b*, and discharge electrodes 11 and 12 are formed on the other surface of the first plate 10*a*. In addition, low work function material layers 15 are formed on portions of the fluorescent layer 14 corresponding to the electrodes 11 and 12. Thus, the portions of the fluorescent layer 14 except for the portions corresponding to the electrodes 11 and 12 are exposed.

Figure 8A:
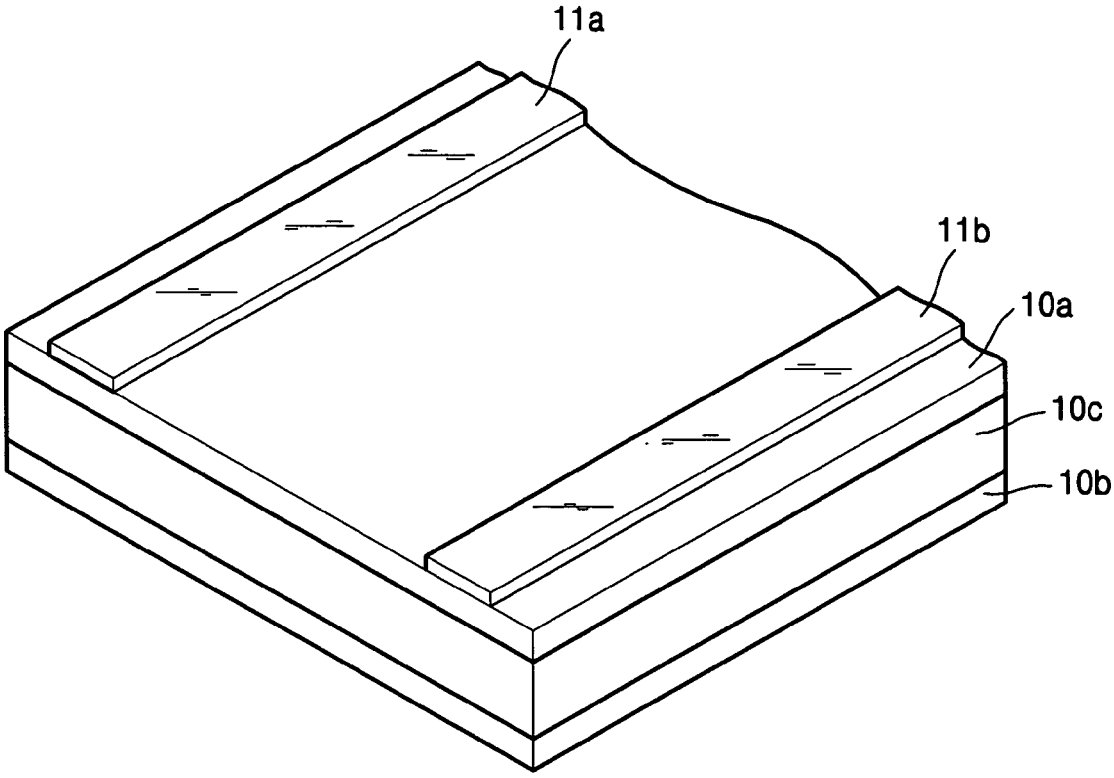
FIGS. 8A and 8B are a perspective view and a sectional view illustrating a first example of the plasma flat lamp according to the seventh embodiment of the present invention shown in FIG. 7, respectively.
Figure 8B:
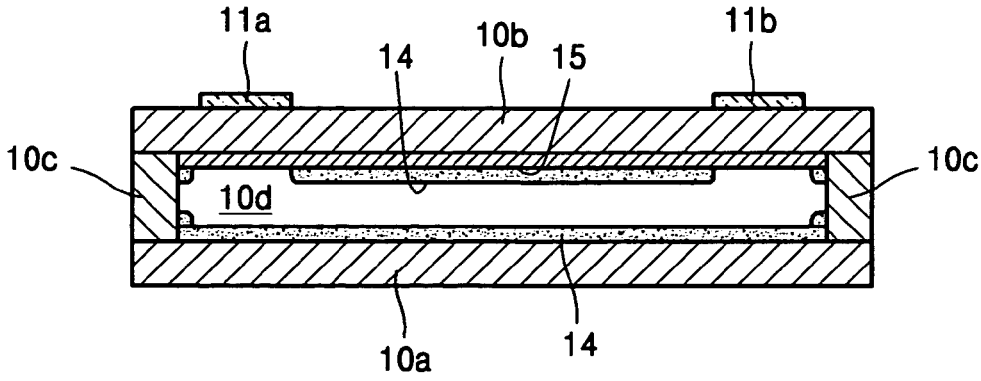

FIGS. 8A and 8B illustrate a first example of the plasma flat lamp according to the seventh embodiment of the present invention shown in FIG. 7. Referring to FIGS. 8A and 8B, a first plate 10*a* and a second plate 10*b* are separated to a predetermined distance by walls 10*c* to form a discharge area 10*d* in which a discharge gas is filled.

A low wok function material layer 15 is formed on a surface of the first plate 10*a* facing the second plate 10*b*, and electrodes 11*a* and 11*b* are formed on the other surface of the first plate 10*a*. On the other hand, fluorescent layers 14 are formed on surfaces of the first plate 10*a* and the second plate 10*b* facing each other. Here, the fluorescent layer 14 is not formed on portions of the first plate 10*a* corresponding to the electrodes 11*a* and 11*b*. Thus, when a discharge occurs between the electrodes 11*a* and 11*b*, ions collide against the portions of the low work function material layer 15 corresponding to the electrodes 11*a* and 11*b* and exposed to the discharge area 10*d*.

Figure 9A:
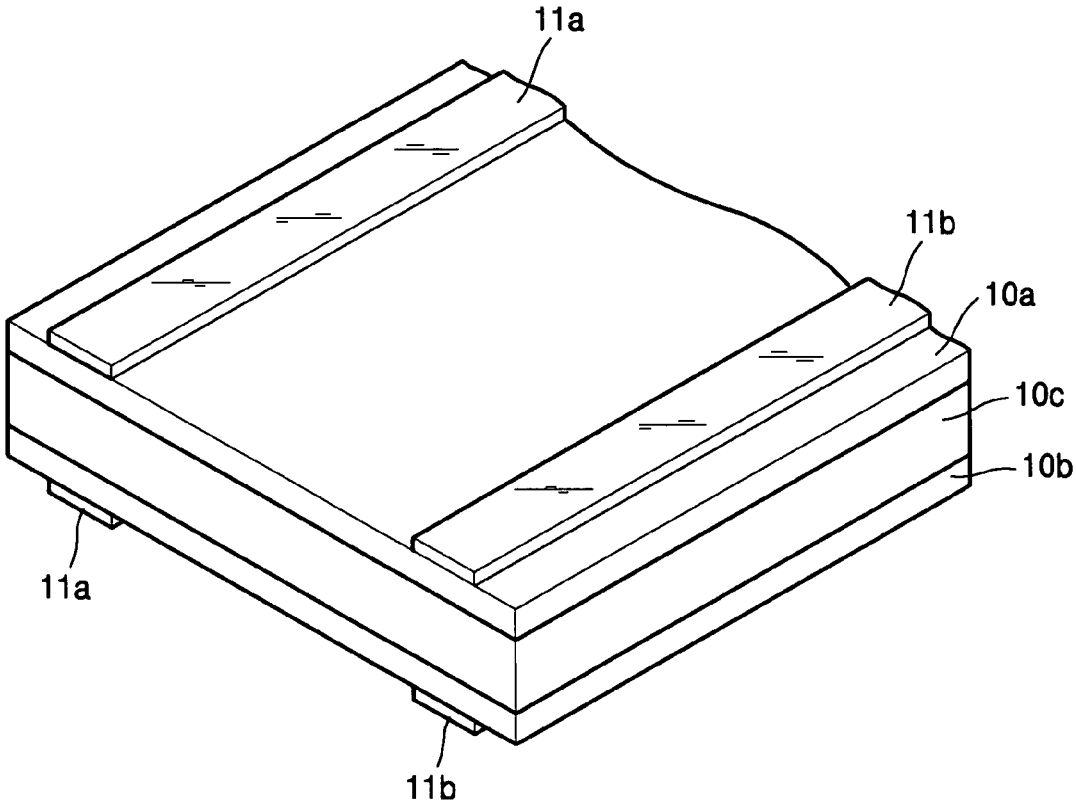
FIGS. 9A and 9B are a perspective view and a sectional view illustrating a plasma flat lamp in which symmetrical electrodes are formed on substrates according to a second example of the seventh embodiment of the present invention shown in FIG. 7, respectively.
Figure 9B:
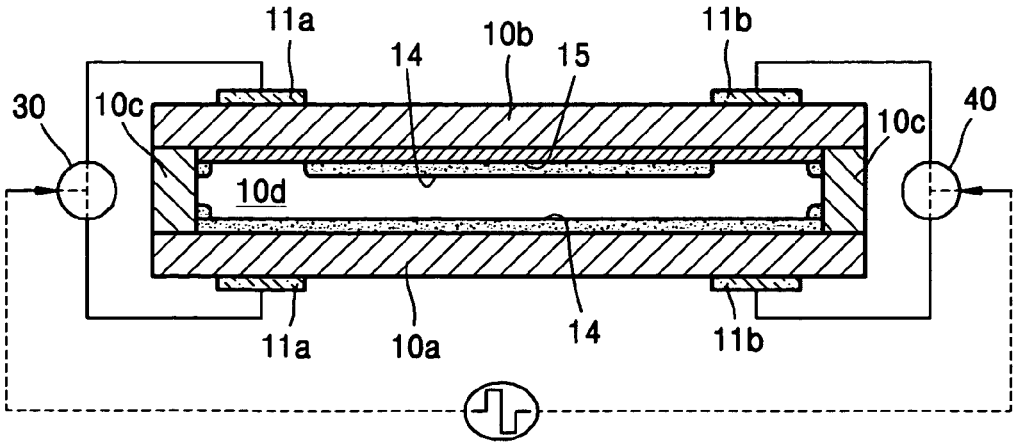

FIGS. 9A and 9B illustrate a second example of the plasma flat lamp according to the seventh embodiment of the present invention shown in FIG. 7. Referring to FIGS. 9A and 9B, a first plate 10*a* and a second plate 10*b* are separated to a predetermined distance by walls 10*c* to form a discharge area 10*d* in which a discharge gas is filled.

A low wok function material layer 15 is formed on a surface of the first plate 10*a* facing the second plate 10*b*, and electrodes 11*a* and 11*b* are formed on the other surface of the first plate 10*a* and a surface of the second plate 10*b* not facing the first plate 10*a*. On the other hand, fluorescent layers 14 are formed on surfaces of the first plate 10*a* and the second plate 10*b* facing each other. Here, the fluorescent layer 14 is not formed on portions of the first plate 10*a* corresponding to the electrodes 11*a* and 11*b*.

The couples of the discharge electrodes 11*a* and 11*b* formed on the first plate 10*a* and the second plate 10*b* face each other with the discharge area 10*d* therebetween, and the electrodes 11*a* on the first plate 10*a* and the second plate 10*b* are electrically connected to maintain the same potential, thus a discharge does not occur between the electrodes 11*a*. In the same manner, the electrodes 11*b* on the first plate 10*a* and the second plate 10*b* maintain the same potential, thus a discharge does not occur between the electrodes 11*b*.

Figure 10:
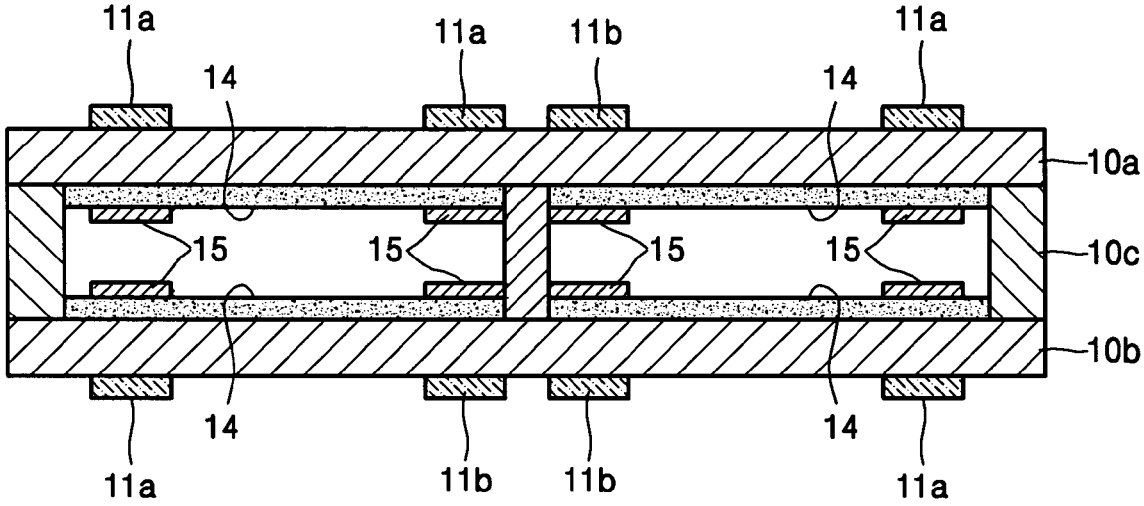
FIG. 10 is a sectional view illustrating a plasma flat lamp in which symmetrical electrodes are formed on substrates according to an eighth embodiment of the present invention.

FIG. 10 is a sectional view illustrating a plasma flat lamp in which symmetrical electrodes are formed on substrates as in FIGS. 9A and 9B, according to an eighth embodiment of the present invention. In this case, fluorescent layers 14 are formed on surfaces of a first plate 10*a* and a second plate 10*b* facing each other, and low work function material layers 15 corresponding to electrodes 11*a* and 11*b* are formed on the fluorescent layers 14.

An experiment was performed to examine the performance of a plasma flat lamp according to the present invention. Here, Ne—Xe was used as a discharge gas at a gas pressure of 152 mbar. A driving frequency was controlled to 20 KHz with a duty of 20%. The experiment was performed on a first specimen in which a MgO layer is formed on a fluorescent layer to a thickness of 5,000 Å, and a second specimen in which a MgO layer is not formed on a fluorescent layer. A breakdown voltage of the second specimen with the MgO layer was 2.76 KV; however, a breakdown voltage of the first specimen according to the present invention was 2.12 KV. As a result, when the MgO layer was formed on the fluorescent layer, the breakdown voltage was reduced by about 640 V. In addition, when the MgO layer was formed on the fluorescent layer, a discharge maintain voltage is reduced by about 620 V, from 1.72 KV to 1.10 KV.

As described above, when the low work function material layer 15 is formed on the portions deviated from the discharge path, the ultraviolet rays may be absorbed by the low work function material layer 15. Thus, it is preferable that the low work function material layer 15 is formed on or exposed to the discharge path and the fluorescent layer 14 is exposed to other portions, as shown in FIGS. 1 through 3. On the other hand, it is preferable that the low work function material layer 15 is formed to a thickness of from 80 to 200 Å to minimize the absorption of the ultraviolet rays as shown in FIG. 4. Here, the thickness of the low work function material layer 15 is determined when the transmission rate of ultraviolet rays, for example, vacuum ultraviolet rays (VUV) with a wavelength of 147 nm, to a MgO layer with an extinction coefficient of 0.3, to 80%.

The low work function material layer 15 is formed of MgO. Such a low work function material layer 15 may be formed of any one selected from $MgF_2$, $CaF_2$, LiF, $Al_2O_3$, ZnO, CaO, SrO, $SiO_2$, and $La_2O_3$.

A plasma flat lamp according to the present invention has a low driving voltage compared to a conventional flat lamp. In order to prevent or repress the absorption of ultraviolet rays, for example, VUV by a low work function material layer to reduce a discharge voltage, the low work function material layer is formed not to cover a fluorescent layer at portions deviated from a discharge path. Thus, the ultraviolet rays are directly input to the fluorescent layer. In addition, when the low work function material layer is formed on the fluorescent layer, the thickness of the low work function material layer is controlled to minimize the loss of the ultraviolet rays.

According to the present invention, a plasma flat lamp with a low driving voltage and high luminescent efficiency is obtained. Such a plasma flat lamp may be used as a light source, for example, a back-light of a liquid crystal display (LCD).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma flat lamp comprising:

a discharge container including a first plate and a second plate that maintain a predetermined distance to form a discharge area;

a discharge gas in the discharge area of the discharge container;

at least two electrodes formed on the discharge container and generating a gas discharge in the discharge area;

a low work function material layer located in a discharge path between the electrodes against which gas ions that are generated by the gas discharge collide; and a fluorescent layer generating visible rays by ultraviolet rays that are generated by the gas discharge in the discharge container.

2. The plasma flat lamp of claim 1, wherein the low work function material layer is formed of any one selected from MgO, $MgF_2$, $CaF_2$, LiF, $Al_2O_3$, ZnO, CaO, SrO, $SiO_2$, and $La_2O_3$.

3. A plasma flat lamp as recited in claim 1, wherein the electrodes are formed on a surface of the first plate and are operative to generate the gas discharge when coupled to opposite polarities of a power source during operation.

4. A plasma flat lamp as recited in claim 3, wherein the surface of the first plate faces the second plate.

5. A plasma flat lamp as recited in claim 4, further comprising:

a dielectric layer formed on the surface of the first plate and the at least two electrodes.

6. A plasma flat lamp comprising:

a first plate and a second plate maintaining a predetermined distance to form a discharge area;

a discharge gas in the discharge area;

at least two electrodes formed on a surface of the first plate facing the second plate;

a dielectric layer formed on a surface of the first plate facing the second plate and covering the electrodes;

a low work function material layer formed on the dielectric layer to correspond to the electrodes; and a fluorescent layer formed on portions of the dielectric layer where the low work function material layer is not formed.

7. The plasma flat lamp of claim 6, wherein the low work function material layer is formed of any one selected from MgO, $MgF_2$, $CaF_2$, LiF, $Al_2O_3$, ZnO, CaO, SrO, $SiO_2$, and $La_2O_3$.

8. The plasma flat lamp of claim 6, wherein the fluorescent layer extends to areas between the dielectric layer and the low work function material layer.

9. The plasma flat lamp of claim 6, wherein the low work function material layer is formed on an entire surface of the dielectric layer.

10. A plasma flat lamp as recited in claim 6, wherein the at least two electrodes are operative to generate a gas discharge when coupled to opposite polarities of a power source during operation.

11. A plasma flat lamp comprising:

a first plate and a second plate maintaining a predetermined distance to form a discharge area;

a discharge gas in the discharge area;

at least two electrodes formed on a surface of the first plate facing the second plate;

a dielectric layer formed on a surface of the first plate facing the second plate and covering the electrodes;

a fluorescent layer formed on the dielectric layer; and a low work function material layer formed on the dielectric layer to a thickness of 80 to 200 Å.

12. A plasma flat lamp as recited in claim 11, wherein the low work function material layer is formed of any one selected from MgO, $MgF_2$, $CaF_2$, LiF, $Al_2O_3$, ZnO, CaO, SrO, $SiO_2$, and $La_2O_3$.

13. A plasma flat lamp as recited in claim 11, wherein the at least two electrodes are operative to generate a gas discharge when coupled to opposite polarities of a power source during operation.

* * * * *